US006290902B1

(12) United States Patent
Zwinkels et al.

(10) Patent No.: US 6,290,902 B1
(45) Date of Patent: Sep. 18, 2001

(54) METHOD FOR PRODUCING TI (C,N)—(TI, TA,W) (C,N)—CO ALLOYS FOR CUTTING TOOL APPLICATIONS

(75) Inventors: Marco Zwinkels, Solna; Ulf Rolander, Stockholm; Gerold Weinl, Älvsjö; Anders Piirhonen, Sandviken, all of (SE)

(73) Assignee: Sandvik AB, Sandviken (SE)

( * ) Notice: Subject to any disclaimer, the term of this patent is extended or adjusted under 35 U.S.C. 154(b) by 0 days.

(21) Appl. No.: 09/563,347

(22) Filed: May 3, 2000

(30) Foreign Application Priority Data

May 3, 1999 (SE) ..... 9901581

(51) Int. Cl.[7] ..... B22F 3/00; B22F 3/10
(52) U.S. Cl. ..... 419/10; 419/47; 419/57
(58) Field of Search ..... 419/10, 47, 57

(56) References Cited

U.S. PATENT DOCUMENTS 5,976,213 * 11/1999 Rolander et al. ..... 75/238

FOREIGN PATENT DOCUMENTS 0 519 895 12/1992 (EP) .
0 578 031 1/1994 (EP) .
98/51830 11/1998 (WO) .

* cited by examiner

*Primary Examiner*—Ngoclan Mai
(74) *Attorney, Agent, or Firm*—Burns, Doane, Swecker & Mathis, L.L.P.

(57) ABSTRACT

The present invention relates to a method for manufacturing a sintered body of carbonitride alloy with titanium as the main component and cobalt as the binder phase and which does not have any compositional gradients or center porosity concentration after sintering. This is achieved by processing the material in a specific manner to obtain a lower melting point of the liquid phase in the interior of the body than in the surface while balancing the gas atmosphere outside the body with the alloy composition during all stages of the liquid phase sintering.

17 Claims, 4 Drawing Sheets

METHOD FOR PRODUCING TI (C,N)— (TI, TA,W) (C,N)— CO ALLOYS FOR CUTTING TOOL APPLICATIONS

FIELD OF THE INVENTION

The present invention relates to a method for manufacturing a sintered body of carbonitride alloy with titanium (Ti) as the main component and cobalt (Co) as the binder phase and which does not have any compositional gradients or center porosity concentration after sintering. More particularly, the present invention is directed to a method of processing the material in a specific manner to obtain a lower melting point of the liquid phase in the interior of the body compared to the surface while balancing the gas atmosphere outside the body with the alloy composition during all stages of liquid phase sintering.

BACKGROUND OF THE INVENTION

Titanium-based carbonitride alloys, so called cermets, are today well established as an insert material in the metal cutting industry and are especially used for finishing operations. They generally comprise carbonitride hard constituents embedded in a metallic binder phase. The hard constituent grains generally have a complex structure with a core surrounded by a rim of a different composition. In addition to titanium, group VIa elements, normally both molybdenum and tungsten and sometimes chromium, are added to facilitate wetting between the binder and hard constituents and to strengthen the binder by means of solution hardening. Group IVa and/or Va elements, i.e., zirconium, hafnium, vanadium, niobium, and tantalum, are also added in all commercial alloys available today. All these additional elements are usually added as carbides, nitrides and/or carbonitrides. The grain size of the hard constituents is usually <2 $\mu$m. The binder phase is normally a solid solution of mainly both cobalt and nickel. The amount of binder phase is generally 3–25 wt %. Other elements are sometimes added as well, e.g. aluminum, which are said to harden the binder phase and/or improve the wetting between hard constituents and binder phase. Of course, commercially available raw material powders also contain inevitable impurities.

The most important impurity is oxygen. Oxygen has a high affinity for titanium. A normal impurity level for oxygen has historically been <0.3 wt %. Recently, due to improved production methods for titanium-based raw materials, this level has been decreased to <0.2 wt %, especially for grades with low nitrogen content. Very high oxygen levels are generally avoided since this may cause formation of carbon monoxide (CO) after pore closure during liquid phase sintering, which in turn leads to excessive porosity.

Cermet inserts are commonly produced by powder metallurgical methods including milling powders of the hard constituents and binder phase, pressing the powder to form green bodies of desired shape and finally, liquid phase sintering the green bodies. Provided that good wetting is obtained between the liquid and the solid hard phase grains, strong capillary forces are obtained. The action of these forces is to shrink the porous body essentially isotropically, thereby eliminating porosity. The linear shrinkage is typically 15–30%.

Sintering of titanium carbonitride-based cermets is a complex process, which requires precise control of all steps to obtain a sintered body with desired properties. Generally, after dewaxing, the material is heated under vacuum or in an inert atmosphere to 1250–1350° C. to enable deoxidation and denitrification of the material. Further heating to the final sintering temperature and subsequent cooling is normally done under vacuum or in an atmosphere that may contain both inert and reactive gases. Each of the steps influences the properties of the sintered material and must therefore be optimized carefully.

Conventional sintering processes yield sintered material with several drawbacks, such as lack of toughness and wear resistance. The sintered bodies commonly have a concentration of pores in the center and a surface with varying degrees of enrichment or depletion of the binder phase. Various attempts have been made to improve process control by varying the gas atmosphere during sintering.

Sintering in nitrogen ($N_2$), accomplished in various ways, provides a means to limit denitrification, which is especially useful for cermets with high nitrogen content.

U.S. Pat. No. 4,990,410 discloses a process for producing a cermet by liquid phase sintering in 0.1–20 torr $N_2$ at temperatures ≧1300° C. A nitrogen atmosphere is proven useful for modification of the near surface properties of sintered cermet bodies. U.S. Pat. No. 5,059,491 discloses a process for producing a cermet with maximum hardness at a depth between 5 and 50 $\mu$m from the surface by liquid phase sintering in $N_2$ and cooling in a vacuum. U.S. Pat. No. 4,985,070 discloses a process for producing a high-strength cermet, which is accomplished by sintering the material in progressively increasing nitrogen pressure. U.S. Pat. No. 5,145,505 discloses a process for producing a tough cermet with a binder-depleted surface by sintering in 5–30 torr $N_2$.

Sintering in CO has been found useful for obtaining improved control over the surface of sintered cermet bodies. WO 99/02746 discloses a process for producing sintered bodies without the common binder phase layer of 1–2 $\mu$m thickness on the surface by sintering in CO at pressures 1–80 mbar.

Sintering in CO—$N_2$ mixtures has been attempted to obtain improved properties of sintered bodies. U.S. Pat. No. 5,856,032 discloses a process for producing Ti(C,N)-based cermets by liquid phase sintering in CO—$N_2$ mixtures. The gas mixture is used to modify the surface zone of the sintered body, down to a depth of 600 $\mu$m. The desired composition of the gas mixture is dependent on the nitrogen content of the hard constituents whereas the total pressure needed is determined by the binder content. The sintered bodies thus produced are characterized in that ≧90% by mass of the Co and/or Ni-binder is present in a surface layer of 0.01–3 $\mu$m depth in comparison to the underlying core amounts in all cases.

U.S. Pat. No. 6,017,488 discloses a process for producing sintered cermet bodies with Co binder. Sintering is performed in CO—$N_2$ mixtures, in which the partial pressures are kept below 20 mbar. The sintered bodies have a unique feature in that they have a macroscopic Co gradient, in which the Co content decreases essentially monotonously from the center of the body to its surface and reaches a Co content at a depth of 0–10 $\mu$m from the surface of 50–99% of that in the center.

A series of titanium carbonitride-based alloys with Co binder are disclosed in U.S. patent application Ser. Nos. 09/563,502, 09/563,501, and 09/564,648, filed concurrently herewith. These have superior performance in metal cutting applications, both with and without single or multiple layer wear-resistant coatings of carbides or nitrides of Ti and/or aluminum oxide. They show a unique behavior during sintering, being quite different from conventional cermets with Ni—Co binder. One feature is the high content of Ta, i.e. ≧2 at %, preferably 4–7 at %, which increases the nitrogen activity in the material during sintering. Another feature is the optimization of the raw materials that has led to significant improvement of performance in metal cutting. Due to these two features these materials differ substantially from conventional materials and hence they require a sintering process, unlike the ones that are commonly used. If they are sintered according to the processes disclosed in U.S. Pat. No. 6,017,488 or U.S. Pat. No. 5,856,032, they will melt in the conventional way, i.e. from the surface inwards, leading to gas entrapment and unacceptable porosity, which should be avoided in order to fully utilize the potential of these materials.

SUMMARY OF THE INVENTION

It is an object of t he p resent invention to provide a method of manufacturing said class of titanium carbonitride-based alloys having Co as a binder and high Ta content, In one aspect of the invention, there is provided a method of liquid phase sintering a body of titanium-based carbonitride alloy comprising hard constituents based on Ti, W, and Ta in a Co binder phase, th e body comprising an atomic N/(C+N) ratio of 25–50 at %, a Ta content of at least 2 at %, a W content of at least 2 at %, and the Co content is 5–25 at %, and sintering is performed under such conditions that a liquid binder phase forms in the center of the body first and then propagates outwardly towards the surface of the body without generating a macroscopic binder phase gradient.

BRIEF DESCRIPTION OF THE DRAWING FIGURES

DETAILED DESCRIPTION OF PREFERRED EMBODIMENTS

Figure 1:
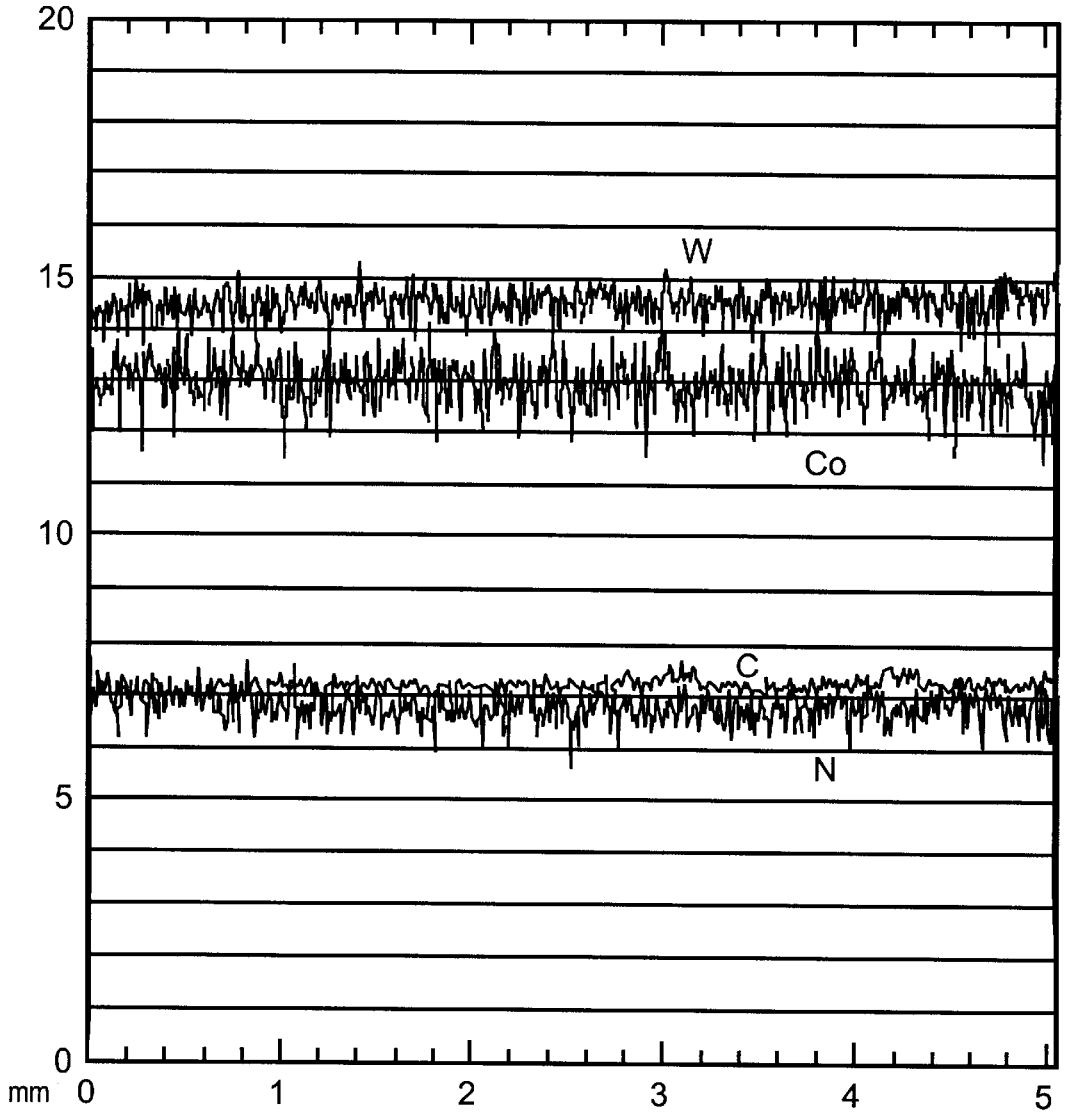
FIG. 1 is an EMPA (Electron microprobe analysis) line scan across an insert of a Ti (C, N)—(Ti,Ta,W) (C,N)—Co alloy sintered by the process of the present invention.

For the alloy class specified above, it has unexpectedly been determined that by utilizing the inventive process, a sintered body without a macroscopic Co gradient can be obtained while maintaining favorable melting, i.e. nucleation, propagating from the center towards the surface. This favorable outcome is achieved by dewaxing the green bodies, followed by increasing the temperature under vacuum to 1250–1350° C. to allow deoxidation and controlled denitrification of the hard phase grains. The denitrification is controlled by the temperature increment and temperature plateaus at suitable levels. Subsequently, sintering is carried out in a predefined gas atmosphere. Different gas compositions are required for:

(1) the temperature rise up to the final sintering temperature;

(2) the plateau at the final temperature; and (3) the temperature decrease to ≧1200° C.

The partial pressures of Co and $N_2$ should be kept constant or increased stepwise or continuously while increasing the temperature up to the final sintering temperature to balance the increasing gas generation rate in the green bodies. Pressures which are too low will result in macroscopic Co gradients, whereas pressures that are too high will revert the melting process, leading to center porosity concentration. The levels for CO and $N_2$ for the onset of sintering are 0.25–3 mbar, preferably 0.5–1.5 mbar. The partial pressure levels for CO and $N_2$ when reaching the final sintering temperature are 1–10 mbar, preferably 2–6 mbar for CO and 0.5–3 mbar, preferably 1–2 mbar for $N_2$.

Controlling the gas atmosphere during the increment from 1250–1350° C. up to the final sintering temperature as described above is useful for eliminating the macroscopic Co gradient. However, the materials for which the currently invented process is useful suffer from enrichment of the hard constituents containing W and Ta in a surface zone of ≦500 μm depth, accompanied by depletion of Co. The enrichment is such that in some cases the contents of W and Ta in a range 0–10 μm from the surface are ≧20% higher than that in the center of the body. It has surprisingly been found out that this enrichment can be eliminated by controlling the composition of the gas atmosphere during the plateau at the final sintering temperature. Both CO and $N_2$ must be controlled to achieve elimination of compositional gradients at a depth of ≦500 μm from the surface of the body. The CO and $N_2$ partial pressures are 0.5–5 mbar, preferably 1–3 mbar for CO and 0.25–3 mbar, preferably 0.5–2 mbar for $N_2$, during the plateau at the final temperature.

Controlling the gas atmosphere during temperature increment and the plateau at the final sintering temperature is not enough to obtain acceptable properties of the actual surface of the sintered body. It has been determined that by choosing proper CO and $N_2$ pressures when decreasing the temperature to a level well below the liquidus temperature of the binder phase, the surface composition at a depth of 0–10 μm is essentially the same as in the bulk. Surface layers of binder or hard constituents can thus be circumvented. The partial pressures of CO and $N_2$ are 0.25–3 mbar, preferably 0.5–2 mbar for CO and 0.25–3 mbar, preferably 0.5–2 mbar for $N_2$, during cooling from the final sintering temperature to ≦1200° C.

EXAMPLE 1

TNMG 160408-PF inserts were pressed using a powder mixture of nominal composition (at %) Ti 37.1, W 3.6, Ta 4.5, C 30.7, N 14.5, and Co 9.6. The green bodies were dewaxed in $H_2$ at a temperature below 350° C. The furnace was then evacuated and pumping was maintained throughout the temperature range 350–1300° C. From 350 to 1050° C., a temperature ramp of 10° C./min was used. From 1050 to 1300° C./min, a temperature ramp of 2° C./min was used. The temperature was held at 1300° C. in vacuum for 30 min. Subsequently, the vacuum valve was closed and the temperature was increased to 1480° C., using a ramp of 2° C./min. Up to 1310° C., the furnace pressure was allowed to increase due to outgassing of the porous bodies. During subsequent heating to the final sintering temperature, followed by cooling to 1200° C., gas mixtures were allowed to flow through the furnace while maintaining a constant pressure of 8 mbar. From 1310 to 1480° C. the gas mixture contained 8.3 vol % Co, 8.3 vol % $N_2$, the balance being argon (Ar). During liquid phase sintering for 90 min at 1480° C. the gas mixture contained 29.2 vol % CO, 12.5 vol % $N_2$, the balance being Ar. From 1480 to 1200° C. a cooling rate of 3.5° C./min was applied, while using a gas mixture of composition 16.7 vol % CO, 12.5 vol % $N_2$, the balance being Ar.

Polished cross sections of the inserts were prepared by standard metallographic techniques and characterized using optical microscopy and electron microprobe analysis (EMPA). Optical microscopy showed that the inserts had an evenly distributed residual porosity in porosity class A04 or better throughout the sintered bodies. The pores were evenly distributed without any pore concentration in the center of the body. FIG. 1 shows an EMPA line scan analysis of Co, W, N and C ranging from one side of the insert, through the interior of the material to the opposite surface. Clearly the concentrations of all elements are constant throughout the insert, within reasonable measurement limits and statistical fluctuations.

EXAMPLE 2 (comparative)

Figure 2:
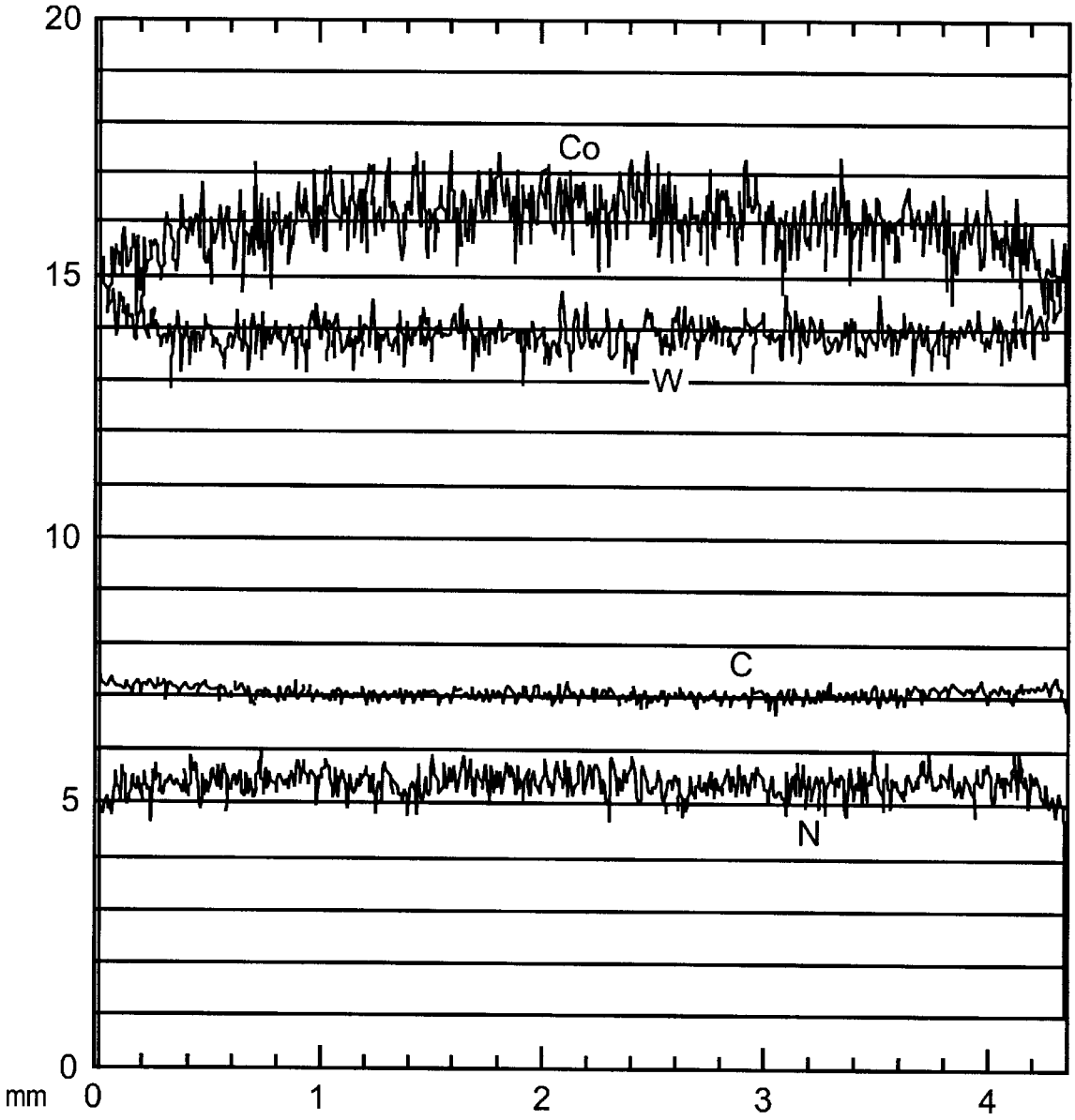
FIG. 2 is an EMPA line scan across an insert of a Ti(C,N)—(Ti,Ta,W) (C,N)—Co alloy sintered in a comparative reference process.

In a second experiment, inserts of nominal composition (at %) Ti 35.9, W 3.6, Ta 4.3, C 27.2, N 16.6, and Co 12.4 were manufactured in an identical manner as described in Example 1, except that Ar gas was allowed to flow through the furnace during the temperature increment from 1310 to 1480° C. In this case a typical macroscopic Co gradient was observed, having a parabolic shape, as can be seen in FIG. 2, showing an EMPA line scan analysis. The Co content at a depth of 0–10 $\mu$m from the surface is 15% lower than that in the center of the insert. Optical microscopy showed that the inserts had an evenly distributed residual porosity in porosity class A04 or better throughout the sintered bodies.

EXAMPLE 3 (comparative)

In a third experiment, inserts of nominal composition (at %) Ti 37.1, W 3.6, Ta 4.5, C 30.7, N 14.5, and Co 9.6 were manufactured in an identical manner as described in Example 1, except that a Co and $N_2$ gas mixture was allowed to flow through the furnace having a composition of CO 50 vol % and $N_2$ 50 vol % at a furnace pressure of 20 mbar during the temperature increment from 1310 to 1480° C. Optical microscopy of a cross section of an insert showed a concentration of pores in the center of the insert, porosity class worse than A08, whereas porosity was in the A04 p or osity class in a zone ≦500 $\mu$m from the surface. EMPA line scan analysis indicated a minimum Co content in the center of the insert. These two observations lead to the conclusion that the binder phase has melted from the outside and inward, trapping gas generated during temperature increment, resulting in unacceptable porosity and unwanted compositional gradients.

EXAMPLE 4 (comparative)

In a fourth experiment, inserts of nominal composition (at %) Ti 37.1, W 3.6, Ta 4.52, C 30.7, N 14.5, and Co 9.6 were manufactured in an identical manner as described in Example 1, except that the gas mixture that was allowed to flow through the furnace was of varying composition during the temperature increment from 1310 to 1480° C. at varying furnace pressures. Moreover, the gas composition was different during liquid phase sintering and cooling to ≦1200° C.

The table below, summarizes the gas composition in the furnace during sintering.

| Temperature | Gas composition (vol %) | | | Furnace pressure |
|---|---|---|---|---|
| (° C.) | CO | $N_2$ | Ar | (mbar) |
| 1310–1340 | 50 | 50 | 0 | 1.5 |
| 1340–1370 | 55 | 45 | 0 | 3 |
| 1370–1400 | 67 | 33 | 0 | 4 |
| 1400–1430 | 75 | 25 | 0 | 5.5 |
| 1430–1480 | 75 | 25 | 0 | 6.5 |
| 1480 (plateau) | 37 | 7 | 56 | 6 |
| 1480–1200 | 23 | 7 | 70 | 6 |

For comparison, inserts of another nominal composition (at %) Ti 40.2, W 3.6, C 27.2, N 16.6, and Co 12.4, without Ta, were manufactured in an identical manner.

Figure 3:
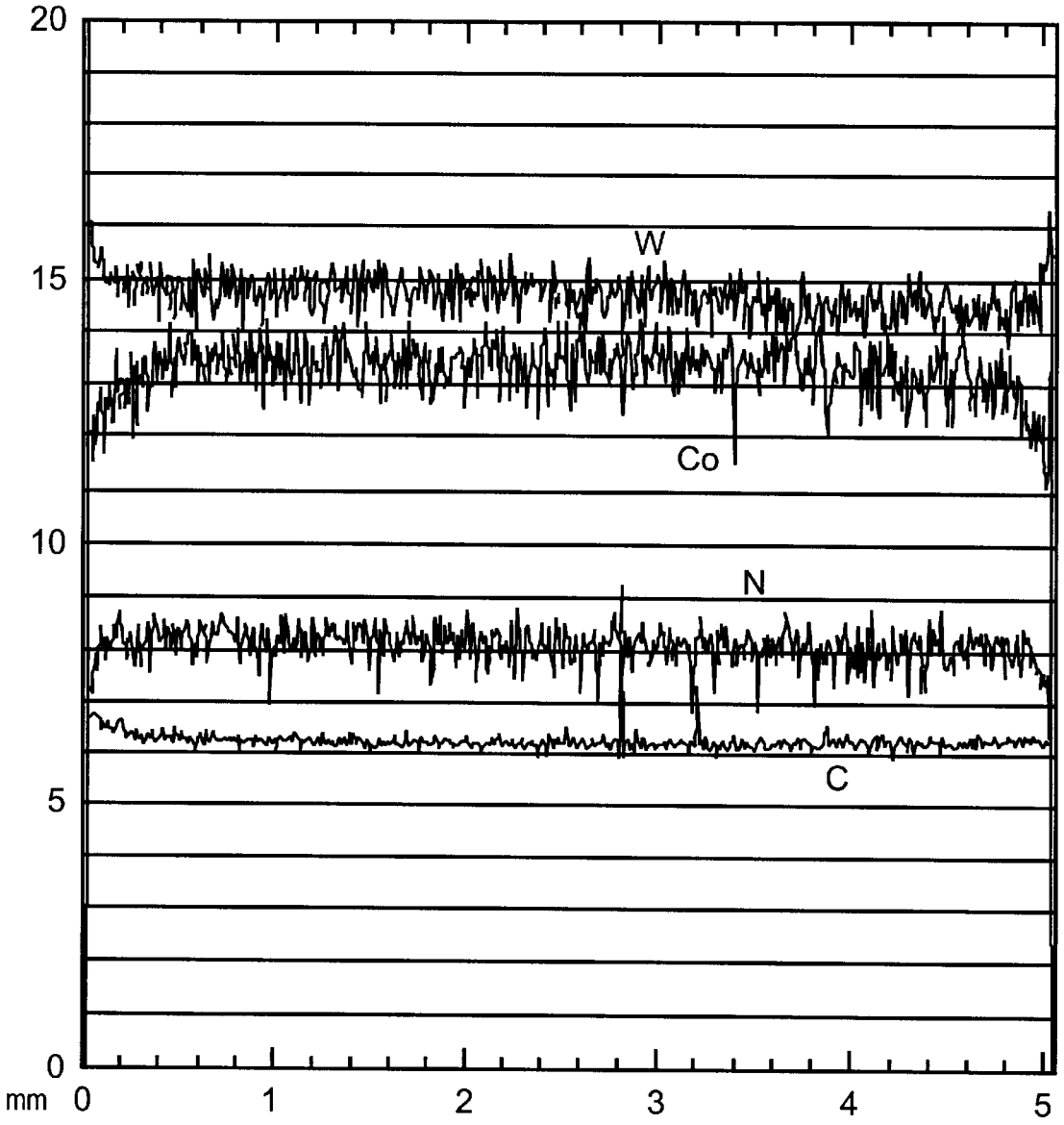
FIG. 3 is an EMPA line scan across an insert of a Ti(C,N)—(Ti,Ta,W) (C,N)—Co alloy sintered in a comparative reference process.
Figure 4:
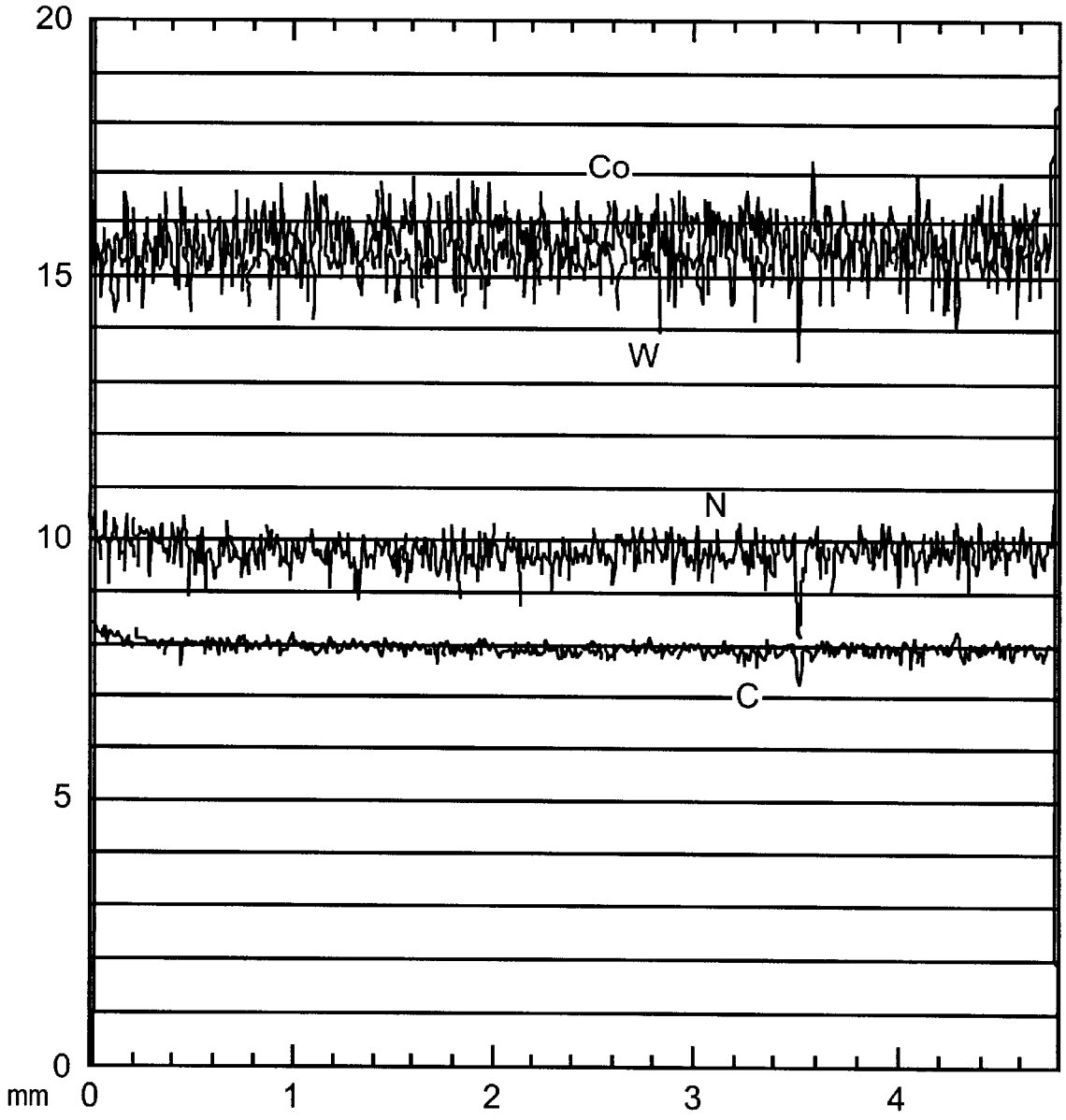
FIG. 4 is an EMPA line scan across an insert of a Ti(C,N)—(Ti,W) (C,N)—Co alloy sintered in a comparative reference process.

FIGS. 3 and 4 show EMPA line scan analyses of the inserts made of the new alloy with Ta and the reference alloy without Ta, respectively. It is concluded from FIG. 3 that no macroscopic Co gradient is observed of the type shown in FIG. 2. Hence, the gas atmosphere during the temperature encasement from 1310 to 1480° C. is well balanced. However, there is a clear depletion of Co in a zone ≦500 $\mu$m from both surfaces. The Co content at a depth of 0–10 $\mu$m from the surface is 12% lower than that in the center of the insert. This indicates an unbalance in the gas atmosphere during the plateau at the sintering temperature. The reference material shows essentially no compositional gradients. Optical microscopy showed a residual porosity in the A04 porosity class or better, throughout the insert for the Ta-containing material and no residual porosity, porosity class A00, for the reference material, without Ta.

The principles, preferred embodiments and mode of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

We claim:

1. A method of liquid phase sintering a body of titanium-based carbonitride alloy comprising hard constituents based on Ti, W, and Ta in a Co binder phase, the body comprising an atomic N/(C+N) ratio of 25–50, a Ta content of at least 2 at %, a W content of at least 2 at %, and the Co content is 5–25 at %, comprising sintering the body under conditions that cause a liquid binder phase to form in the center of the body first and then propagate outwardly towards the surface of the body without generating a macroscopic binder phase gradient.

2. The method of claim 1, wherein sintering is performed under such conditions that essentially no depletion or enrichment of any of the constituents is observed in any part of the sintered body.

3. The method of claim 1, wherein sintering is performed under such conditions that said body contains porosity in the class A06 or less, evenly distributed throughout the volume, without a concentration of pores in the center of the body.

4. The method of claim 1, wherein the sintering process comprises a temperature rise from a temperature 1250–1350° C. to a final sintering temperature of 1370–1550° C., with a temperature increment rate is 0.5–5° C./min.

5. The method of claim 1, wherein during cooling between a final sintering temperature and ≦1200° C., the temperature is decreased at a rate of 0.5–5° C./min.

6. The method of claim 1, wherein during a temperature rise from a temperature of 1250–1350° C. to a final sintering temperature, $N_2$ and CO partial pressures are kept constant.

7. The method of claim 6, wherein the $N_2$ and CO partial pressures are 0.25–3 mbar at 1300° C., and that the $N_2$ and CO partial pressures are 0.5–3 mbar and 1–10 mbar, respectively, when reaching the final sintering temperature.

8. The method of claim 6, wherein the holding time at final sintering temperature is 30–120 minutes.

9. The method of claim 6, wherein the $N_2$ and CO partial pressures are 0.25–3 mbar, and 0.5–5 mbar, respectively, during the hold at the final sintering temperature.

10. The method of claim 6, wherein the $N_2$ and CO partial pressures are 0.25–3 mbar, and 0.25–3 mbar, respectively, during cooling from the final sintering temperature to ≦1200° C.

11. The method of claim 1, wherein the body comprises 4–7 at % Ta, and 3–8 at % W.

12. The method of claim 3, wherein the body comprises a porosity in the class of A04 or less.

13. The method of claim 1, wherein during a temperature rise from a temperature of 1250–1350° C. to a final sintering temperature, $N_2$ and CO partial pressures are increased continuously.

14. The method of claim 1, wherein during a temperature rise from a temperature of 1250–1350° C. to a final sintering temperature, $N_2$ and CO partial pressures are increased in a stepwise manner.

15. The method of claim 7, wherein the $N_2$ and CO partial pressures are 0.5–1.5 mbar at 1300° C., and that the $N_2$ and CO partial pressures are 1–2 mbar and 2–6 mbar, respectively, when reaching the final sintering temperature.

16. The method of claim 9, wherein the $N_2$ and CO partial pressures are 0.5–2 mbar and 1–3 mbar, respectively, during the hold at the final sintering temperatures.

17. The method of claim 10, wherein the $N_2$ and CO partial pressures are 0.5–2 mbar and 0.5–2 mbar, respectively, during cooling from the final sintering temperature to ≦1200° C.

* * * * *